US012326001B2

(12) United States Patent
Ylikangas et al.

(10) Patent No.: US 12,326,001 B2
(45) **Date of Patent: *Jun. 10, 2025**

(54) PANEL WITH LOCKING DEVICE

(71) Applicant: Välinge Innovation AB, Viken (SE)

(72) Inventors: Roger Ylikangas, Lerberget (SE); Thomas Meijer, Viken (SE)

(73) Assignee: VÄLINGE INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/825,654

(22) Filed: May 26, 2022

(65) Prior Publication Data

US 2022/0282494 A1 Sep. 8, 2022

Related U.S. Application Data

(63) Continuation of application No. 17/030,966, filed on Sep. 24, 2020, now Pat. No. 11,365,546.

(30) Foreign Application Priority Data

Sep. 25, 2019 (SE) ..... 1951084-1

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0146* (2013.01); *E04F 2201/041* (2013.01)

(58) Field of Classification Search
CPC ..... E04F 15/02038; E04F 13/0894; E04F 2201/041; E04F 2201/0146
See application file for complete search history.

(56) References Cited

U.S. PATENT DOCUMENTS 7,051,486 B2 5/2006 Pervan
7,454,875 B2 11/2008 Pervan et al.
(Continued)

FOREIGN PATENT DOCUMENTS

DE 202 03 311 U1 5/2002
DE 10 2007 019 786 A1 6/2008
(Continued)

OTHER PUBLICATIONS

U.S. Appl. No. 16/253,465, Darko Pervan and Marcus Nilsson Ståhl, filed Jan. 22, 2019, (Cited herein as US Patent Application Publication No. 2019/0394314 A1 of Dec. 26, 2019 and as Republication No. US 2020/0412852 A9 of Dec. 31, 2020).
(Continued)

*Primary Examiner* — Gisele D Ford
(74) *Attorney, Agent, or Firm* — Boone IP Law

(57) ABSTRACT

A set of panels includes first and second panels, and a mechanical locking device for assembly by vertical relative displacement of the panels. A locking strip extends from a first edge of the first panel in a direction parallel to first and second panel surfaces of the first panel. The locking strip includes a locking strip edge, and first and second locking strip surfaces respectively extending in directions substantially corresponding to those of the first and second panel surfaces. The locking strip includes a locking element cooperating with a locking groove at a second edge of the second panel for locking in a direction parallel to the first panel surface. Opposite edges respectively include cooperating tongue and tongue groove for vertical locking. The first and second edges respectively include first and second engaging positioning elements to decrease vertical movement of the panels in the locked position.

20 Claims, 7 Drawing Sheets

(56) References Cited

U.S. PATENT DOCUMENTS 7,584,583 B2 9/2009 Bergelin et al.
7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,365,499 B2 2/2013 Nilsson et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,756,899 B2 6/2014 Nilsson et al.
8,763,341 B2 7/2014 Pervan
8,769,905 B2 7/2014 Pervan
8,776,473 B2 7/2014 Pervan et al.
8,806,832 B2 8/2014 Kell
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,103,126 B2 8/2015 Kell
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,249,581 B2 2/2016 Nilsson et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,047,527 B2 8/2018 Nilsson et al.
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,526,793 B2 1/2020 Nilsson et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo
10,828,798 B2 11/2020 Fransson
10,933,592 B2 3/2021 Blomgren et al.
10,934,721 B2 3/2021 Pervan et al.
10,953,566 B2 3/2021 Fransson et al.
10,968,639 B2 4/2021 Pervan et al.
10,975,577 B2 4/2021 Pervan et al.
10,995,501 B2 5/2021 Pervan
11,045,933 B2 6/2021 Fransson et al.
11,053,691 B2 7/2021 Pervan
11,053,692 B2 7/2021 Pervan
11,060,302 B2 7/2021 Ylikangas et al.
11,066,835 B2 7/2021 Boo
11,078,673 B2 8/2021 Pervan et al.
11,091,920 B2 8/2021 Kell
11,131,099 B2 9/2021 Pervan
11,174,646 B2 11/2021 Pervan
11,193,283 B2 12/2021 Pervan et al.
11,261,608 B2 3/2022 Pervan
11,274,453 B2 3/2022 Pervan
11,326,353 B2 5/2022 Nilsson et al.
11,331,824 B2 5/2022 Myllykangas et al.
12,116,787 B2 * 10/2024 Quist ..... E04F 15/02155
2003/0205017 A1 11/2003 Palmberg
2004/0016196 A1 1/2004 Pervan
2005/0160694 A1 7/2005 Pervan
2005/0210810 A1 9/2005 Pervan
2006/0053724 A1 3/2006 Braun et al.
2006/0070333 A1 4/2006 Pervan
2006/0101769 A1 5/2006 Pervan
2006/0236642 A1 10/2006 Pervan

(56) References Cited

U.S. PATENT DOCUMENTS

2006/0260254 A1 11/2006 Pervan et al.
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1 5/2009 Pervan et al.
2009/0193748 A1 8/2009 Boo et al.
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0056167 A1 3/2011 Nilsson et al.
2011/0088344 A1 4/2011 Pervan et al.
2011/0088345 A1 4/2011 Pervan
2011/0154763 A1 6/2011 Bergelin et al.
2011/0167750 A1 7/2011 Pervan
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0174520 A1 7/2012 Pervan
2012/0279161 A1 11/2012 Håkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111758 A1 5/2013 Nilsson et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1 10/2013 Boo
2013/0318906 A1 12/2013 Pervan et al.
2014/0007539 A1 1/2014 Pervan et al.
2014/0020324 A1 1/2014 Pervan
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0190112 A1 7/2014 Pervan
2014/0208677 A1 7/2014 Pervan et al.
2014/0223852 A1 8/2014 Pervan
2014/0237924 A1 8/2014 Nilsson et al.
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0325930 A1 11/2014 Schneider
2014/0366476 A1 12/2014 Pervan
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2015/0368910 A1 12/2015 Kell
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0108624 A1 4/2016 Nilsson et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelöv
2017/0037641 A1 2/2017 Nygren et al.
2017/0081860 A1 3/2017 Boo
2017/0254096 A1 9/2017 Pervan
2017/0321433 A1 11/2017 Pervan et al.
2017/0362834 A1 12/2017 Pervan et al.
2018/0001509 A1 1/2018 Myllykangas et al.
2018/0001510 A1 1/2018 Fransson
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan
2018/0094441 A1 4/2018 Boo
2018/0119429 A1 5/2018 Schulte
2018/0119431 A1 5/2018 Pervan et al.
2018/0178406 A1 6/2018 Fransson et al.
2018/0313093 A1 11/2018 Nilsson et al.
2019/0024387 A1 1/2019 Pervan
2019/0048592 A1 2/2019 Boo
2019/0048596 A1 2/2019 Pervan
2019/0063076 A1 2/2019 Boo et al.
2019/0093370 A1 3/2019 Pervan et al.
2019/0093371 A1 3/2019 Pervan
2019/0119928 A1 4/2019 Pervan et al.
2019/0127989 A1 5/2019 Kell
2019/0127990 A1 5/2019 Pervan et al.
2019/0145108 A1 5/2019 Hannig et al.
2019/0169859 A1 6/2019 Pervan et al.
2019/0232473 A1 8/2019 Fransson et al.
2019/0271165 A1 9/2019 Boo
2019/0376298 A1 12/2019 Pervan et al.
2019/0394314 A1 12/2019 Pervan et al.
2020/0087927 A1 3/2020 Pervan
2020/0102756 A1 4/2020 Pervan
2020/0109569 A1 4/2020 Pervan
2020/0149289 A1 5/2020 Pervan
2020/0173175 A1 6/2020 Pervan
2020/0224430 A1 7/2020 Ylikangas et al.
2020/0232225 A1 7/2020 Fahle et al.
2020/0263437 A1 8/2020 Pervan

(56) References Cited

U.S. PATENT DOCUMENTS

| | | | |
|---|---|---|---|
| 2020/0284045 | A1 | 9/2020 | Kell |
| 2020/0318667 | A1 | 10/2020 | Derelöv |
| 2020/0354969 | A1 | 11/2020 | Pervan et al. |
| 2020/0362567 | A1 | 11/2020 | Nilsson et al. |
| 2020/0412852 | A9 | 12/2020 | Pervan et al. |
| 2021/0016465 | A1 | 1/2021 | Fransson |
| 2021/0047840 | A1 | 2/2021 | Pervan |
| 2021/0047841 | A1 | 2/2021 | Pervan et al. |
| 2021/0062517 | A1 | 3/2021 | Markovski et al. |
| 2021/0071428 | A1 | 3/2021 | Pervan |
| 2021/0087831 | A1 | 3/2021 | Nilsson et al. |
| 2021/0087832 | A1 | 3/2021 | Boo |
| 2021/0087833 | A1 | 3/2021 | Ylikangas et al. |
| 2021/0087834 | A1 | 3/2021 | Ylikangas et al. |
| 2021/0310257 | A1 | 10/2021 | Boo |
| 2021/0348396 | A1 | 11/2021 | Pervan et al. |
| 2021/0381255 | A1 | 12/2021 | Ylikangas et al. |
| 2022/0025657 | A1 | 1/2022 | Pervan |
| 2022/0025658 | A1 | 1/2022 | Kell |
| 2022/0143718 | A1 | 5/2022 | Pervan et al. |

FOREIGN PATENT DOCUMENTS

| | | | |
|---|---|---|---|
| DE | 202018006151 | U1 | 5/2019 |
| EP | 1 325 201 | A1 | 7/2003 |
| WO | WO 2005/088029 | A1 | 9/2005 |
| WO | WO 2018/063047 | A1 | 4/2018 |
| WO | WO 2019/145521 | A1 | 8/2019 |
| WO | WO 2020/078549 | A1 | 4/2020 |

OTHER PUBLICATIONS

U.S. Appl. No. 17/030,923, Christian Boo, filed Sep. 24, 2020, (Cited herein as US Patent Application Publication No. 2021/0087832 A1 of Mar. 25, 2021).

U.S. Appl. No. 17/031,166, Roger Ylikangas, Thomas Meijer and Anders Nilsson, filed Sep. 24, 2020, (Cited herein as US Patent Application Publication No. 2021/0087834 A1 of Mar. 25, 2021).

U.S. Appl. No. 17/368,075, Richard William Kell, filed Jul. 6, 2021, (Cited herein as US Patent Application Publication No. 2022/0025658 A1 of Jan. 27, 2022).

U.S. Appl. No. 17/716,622, Anders Nilsson, Karl Quist, Roger Ylikangas, Fredrik Boo, filed Apr. 8, 2022.

International Search Report and Written Opinion dated Oct. 29, 2020 in PCT/IB2020/058921, Patent-och registreringsverket, Stockholm, SE, 10 pages.

Nilsson, Anders, et al., U.S. Appl. No. 17/716,622 entitled "Set of Panels," filed in the U.S. Patent and Trademark Office on Apr. 8, 2022.

Supplementary European Search Report mailed on Oct. 9, 2023, by the European Patent Office for European Application No. (EP20869851.4), 11 pages.

U.S. Appl. No. 17/716,622, Anders Nilsson, filed Apr. 8, 2022.

U.S. Appl. No. 17/842,122, Christian Boo, filed Jun. 16, 2022.

U.S. Appl. No. 18/057,811, Darko Pervan, filed Nov. 22, 2022.

U.S. Appl. No. 18/176,003, Richard William Kell, filed Feb. 28, 2023.

U.S. Appl. No. 18/309,118, Christian Boo, filed Apr. 28, 2023.

U.S. Appl. No. 18/223,091, Roger Ylikangas, filed Jul. 18, 2023.

U.S. Appl. No. 18/407,549, Karl Quist, filed Jan. 9, 2024

U.S. Appl. No. 18/631,407, Darko Pervan, filed Apr. 10, 2024.

* cited by examiner

FIG.8B
FIG.8A
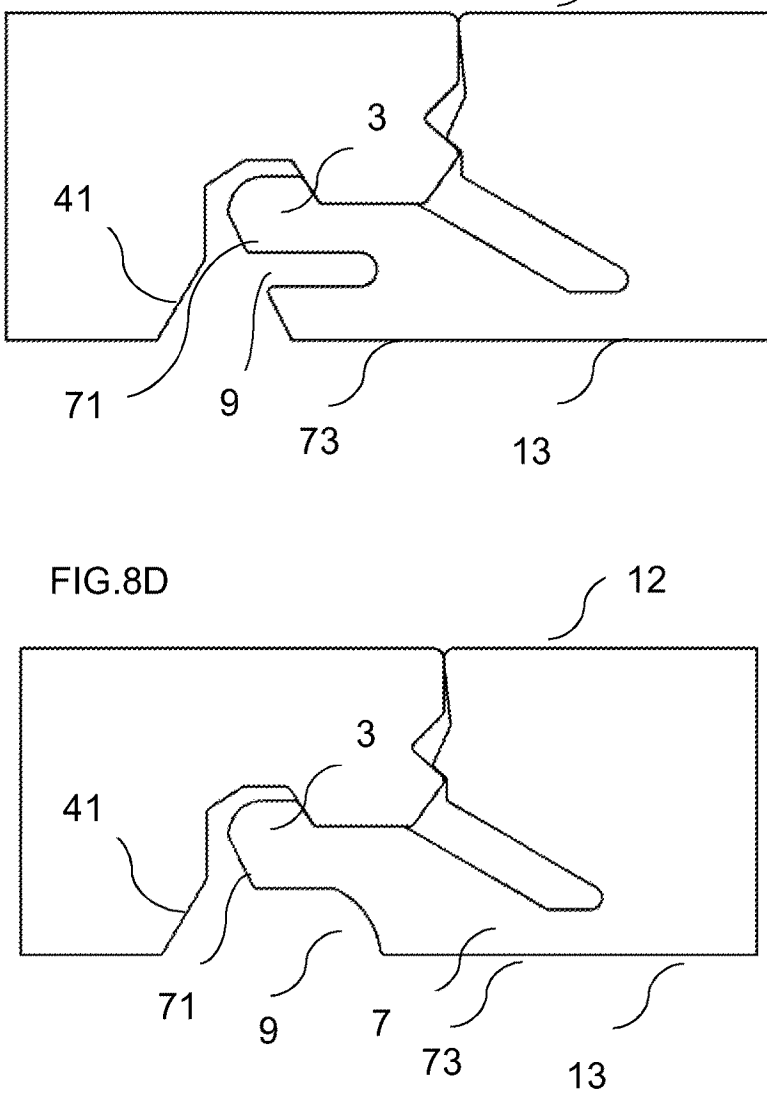
FIG.8D
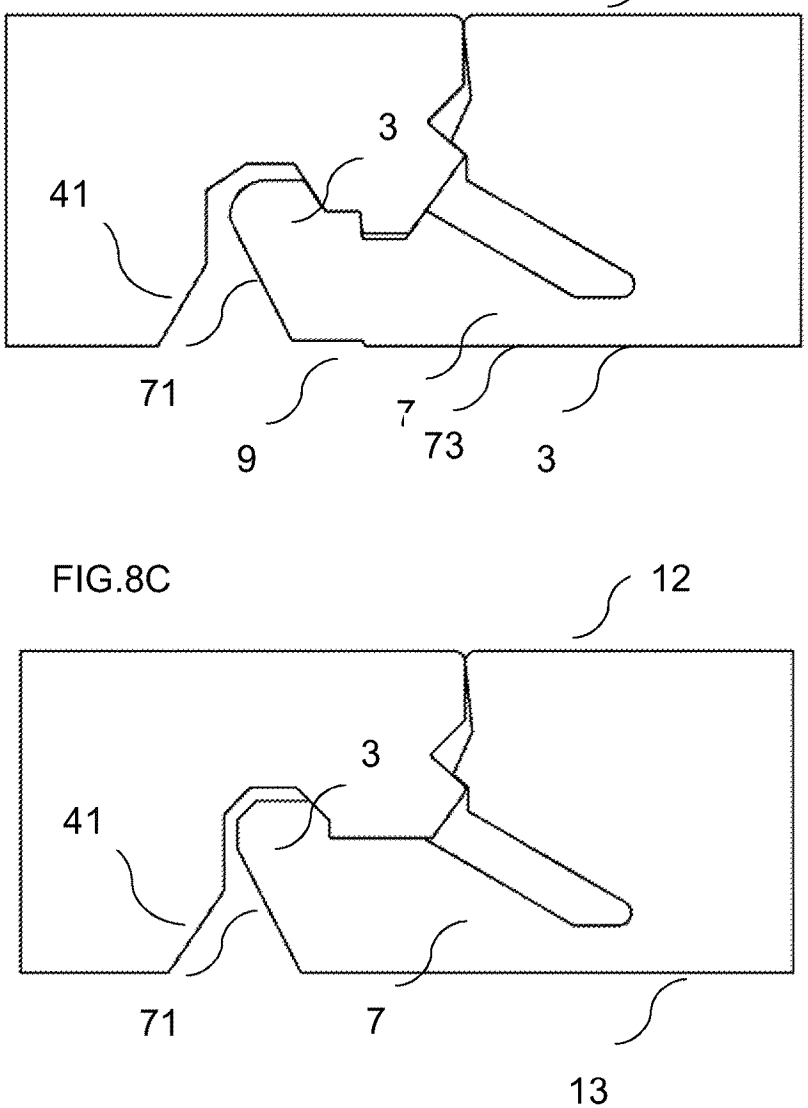
FIG.8C

PANEL WITH LOCKING DEVICE

CROSS REFERENCE TO RELATED APPLICATIONS

The present application is a continuation of U.S. application Ser. No. 17/030,966, filed on Sep. 24, 2020, which claims the benefit of Swedish Application No. 1951084-1, filed on Sep. 25, 2019. The entire contents of each of U.S. application Ser. No. 17/030,966 and Swedish Application No. 1951084-1 are hereby incorporated herein by reference in their entirety.

TECHNICAL FIELD

Embodiments of the present disclosure relate to panels configured to be locked together with a mechanical locking device. The panels may be floorboards configured to be locked together to obtain a floor product.

TECHNICAL BACKGROUND

Panels are known that are configured to be assembled by a vertical displacement and to be locked together in a vertical direction and in a horizontal direction. Such panels are disclosed in e.g., WO 2018/063047. A tongue and groove connection locks a first edge of a first panel to a second edge of the second panel. The first edge and the second edge furthermore comprise a locking element configured to cooperate with a locking groove for locking in the vertical direction and the horizontal direction.

The above description of various known aspects is the applicant's characterization of such, and is not an admission that any of the above description is considered as prior art.

Embodiments of the present disclosure address a need to provide panels that can be easily assembled.

SUMMARY

It is an object of certain aspects of the present disclosure to provide an improvement over the above described techniques and known art.

A further object of at least certain aspects of the present disclosure is to facilitate the assembling of panels configured to be assembled by a vertical displacement and locked together in the vertical direction and the horizontal direction.

A further object of at least certain aspects of the present disclosure is to improve the properties of the assembled set of the panels when is use, such as by minimizing undesired sound occurring when a pressure is applied on the assembled set.

According to an aspect there is provided a set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending in a direction substantially corresponding to direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, characterized in the first edge comprises a first positioning element and a second edge comprises a second positioning element, the first and second positioning elements being configured to engage with each other and decrease vertical movement of the second panel relative to the first panel toward the second panel surface in the locked position.

According to another aspect there is provided the set of panels, wherein the first and second positioning elements have corresponding engaging surfaces, and wherein a first angle between the engaging surface of the first positioning element, and a second angle between the engaging surfaces of the second positioning element, are both about 90°.

According to another aspect there is provided the set of panels, wherein the first positioning element is located on a portion of the first edge, preferably located between the first panel surface and the tongue or tongue groove.

According to another aspect there is provided the set of panels, wherein the second positioning element is located on a corresponding portion of the second edge.

According to another aspect there is provided the set of panels, wherein the first positioning element is located on the tongue groove and the second positioning element is located on the tongue.

According to another aspect there is provided the set of panels, wherein the first positioning element is formed by the tongue groove and the second positioning element is formed by the tongue.

According to another aspect there is provided the set of panels, wherein the first positioning element is located on the first locking strip surface.

According to another aspect there is provided the set of panels, wherein the first positioning element is formed by the first locking strip surface and an adjusting wall of the locking element.

According to another aspect there is provided the set of panels, wherein the mechanical locking device comprises a first flexing groove extending from a transition between the first locking strip surface and the first edge and into the first panel at a third angle from the first panel surface, and that the locking strip is configured to flex by varying a shape of the first flexing groove during the assembly, thereby increasing a flexibility of the locking strip during the assembly.

According to another aspect there is provided the set of panels, wherein the third angle $\alpha$ is within the range of about 0° to about 30°, preferably within the range of about 0° to about 20°, more preferably within the range of about 0° to about 10°, even more preferably within the range of about 0° to about 5°.

According to another aspect there is provided the set of panels, wherein an opening of the first flexing groove has a width T.

According to another aspect there is provided the set of panels, wherein the width T of the opening of the first flexing groove is within the range of about 0.6 mm to about 2.5 mm, preferably about 0.8 mm to about 2.0 mm, more preferably about 1.6 mm.

According to another aspect there is provided the set of panels, wherein the ratio between the width T of the opening of the first flexing groove and a thickness Q of the first panel between the first panel surface and the second panel surface is within the range of about 0.05 to about 0.40, preferably about 0.1 to about 0.3, more preferably about 0.15-0.20.

According to another aspect there is provided the set of panels, wherein the first flexing groove has a depth D that is within the range of about 2.5 mm to about 15 mm, preferably about 4 mm to about 12 mm, more preferably about 5 mm to about 10 mm, even more preferably about 7 mm.

According to another aspect there is provided the set of panels, wherein the ratio between the depth D of the first flexing groove and the width T of the first flexing groove is about 2 to about 10, preferably about 3 to about 7, more preferably about 4 mm.

According to another aspect there is provided the set of panels, wherein the groove has a bottom, the bottom is preferably convex shaped.

According to another aspect there is provided the set of panels, wherein the first locking strip surface has a length Z that is within the range of about 2 mm to about 10 mm, preferably about 3 mm to about 5 mm, more preferably about 4 mm.

According to another aspect there is provided the set of panels, wherein the ratio between the length Z of the first locking strip surface and the width T of the opening of the first flexing groove is within the range of about 1 to about 6, preferably about 2 to about 5, or preferably about 2.5 mm.

According to an aspect there is provided the set of panels, wherein the locking element is chamfered, beveled or arch-shaped.

According to another aspect there is provided the set of panels, wherein the locking strip comprises a second flexing groove extending from the locking strip edge surface into the locking strip, and the locking strip is configured to flex by varying a shape of the second flexing groove during the assembly, thereby increasing a flexibility of the locking strip during the assembly.

According to another aspect there is provided the set of panels, wherein the locking strip edge is beveled or curved.

According to another aspect there is provided the set of panels, wherein the panels are floor panels or wall panels.

According to an aspect the core of the first panel and/or of the second panel may be a wood-based core, preferably made of MDF, HDF, OSB, WPC, plywood or particleboard. The core may also be a plastic core comprising thermosetting plastic or thermoplastic, e.g., vinyl, PVC, PU or PET. The plastic core may comprise fillers. The core may also be mineral based board which may comprise, e.g., MgO.

The first panel and/or the second panel may also be of solid wood.

The first panel and/or the second panel may be provided with a decorative layer, such as a foil or a veneer, on one or more surfaces.

BRIEF DESCRIPTION OF THE DRAWINGS

These and other aspects, features and advantages of which embodiments of the disclosure are capable of, will be apparent and elucidated from the following description of embodiments and aspects of the present disclosure, reference being made to the accompanying drawings.

FIGS. 2A-2C each show a side view of an illustrative first panel comprising a first positioning element and an illustrative second panel comprising a second positioning elements, wherein FIG. 2A is a side view of the panels in an assembled state, and FIGS. 2B-2C are side views during assembling. The first positioning element is located on a portion of the first edge between the first panel surface and the tongue groove. FIG. 2C shows an enlargement of the encircled area shown in FIG. 2A, during assembling.

FIG. 3A is a side view of unassembled panels. FIG. 3B is the same embodiment in the assembled state. FIG. 3C is an enlargement of the section wherein the first and second positioning elements are located on the tongue groove and the tongue respectively.

FIG. 4A is a side view of unassembled panels. FIG. 4B is the same embodiment in an assembled state. FIG. 4C shows a side view of a set of the panels according to another embodiment wherein a first positioning is located on the first locking strip surface 72.

FIG. 5A is a view in an unassembled state and FIG. 5 B shows the same embodiment in the assembled state.

FIGS. 8A-8D each show a side view of a set of illustrative panels in an assembled state, wherein the first groove surface 41 is beveled. FIGS. 8A, 8B and 8D show different illustrative embodiments of the second flexing groove.

DETAILED DESCRIPTION

Figure 1A:
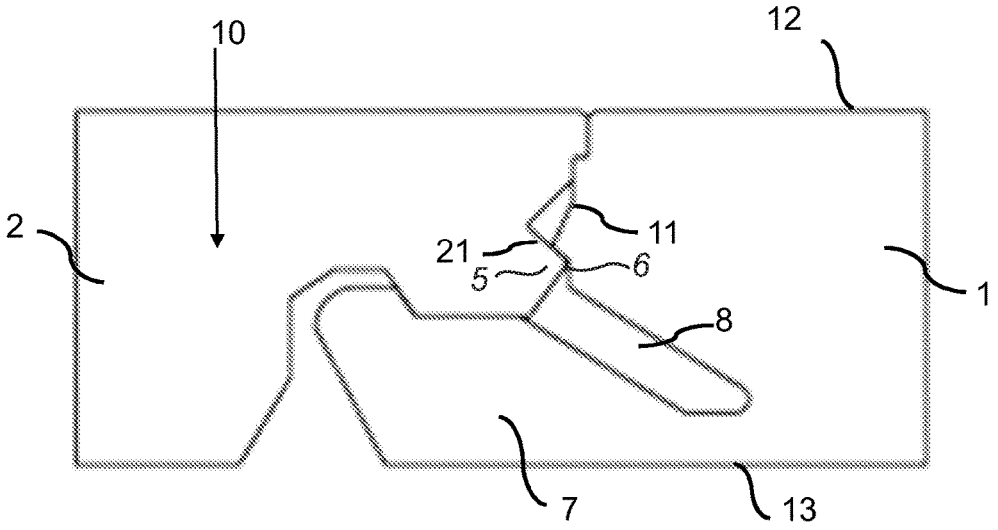
FIGS. 1A and 1B each show a side view of a set of illustrative panels in an assembled state, using positional elements.

Specific embodiments of the disclosure will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the disclosure to those skilled in the art. The terminology used in the detailed description of the embodiments illustrated in the accompanying drawings is not intended to be limiting of the invention. In the drawings, like numbers refer to like elements.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example aspects may be implemented at least in part by means of both hardware and software, and that several "means", "units" or "devices" may be represented by the same item of hardware.

The different aspects, alternatives and embodiments of the disclosure herein can be combined with one or more of the other aspects, alternatives and embodiments described herein. Two or more aspects can be combined.

Figure 1B:
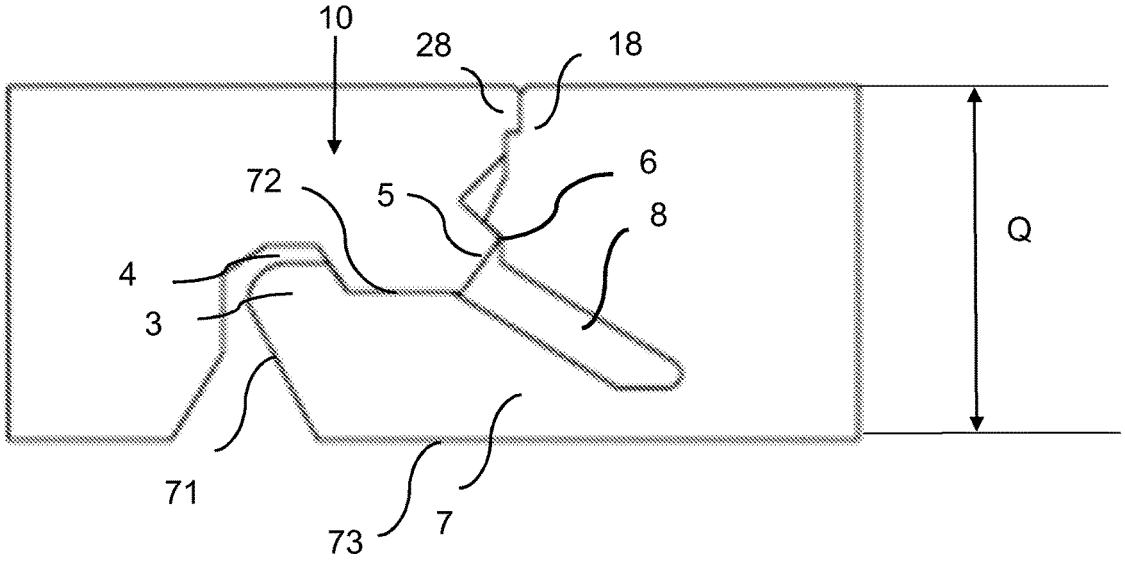

A first aspect of the disclosure is shown, e.g., in FIGS. 1A-1B, which show a set of panels comprising a first panel 1, a second panel 2 and a mechanical locking device for locking the first panel 1 to the second panel 2. The mechanical locking device is configured for an assembly by a displacement of the second panel 2 in relation to the first panel 1 in a vertical direction to obtain a locked position of the first panel 1 and the second panel 2. The first panel 1 comprises a first edge 11, a first panel surface 12, and a second panel surface 13. The second panel 2 comprises a second edge 21.

The mechanical locking device comprises a locking strip 7 extending from the first edge 11 in a direction parallel to the first and second panel surfaces 12, 13. The locking strip 7 comprises a locking strip edge 71. The locking strip 7 comprises a first locking strip surface 72 extending in a direction substantially corresponding to the direction of the first panel surface 12 of the first panel 1. By "substantially corresponding" it is meant that the noted directions may form an angle within a range of +/−10 degrees. The locking strip 7 comprises a second locking strip surface 73 extending in a direction substantially corresponding to direction of the second panel surface 13 of the first panel 1. The locking strip 7 comprises a locking element 3 configured to cooperate with a locking groove 4 at the second edge 21 of the second panel 2 for locking in a direction parallel to the first panel surface 12. The first or second edge 11, 21 comprises a tongue 5 configured to cooperate with a tongue groove 6 at the opposite first or second edge 11, 21 for locking in a vertical direction. The first edge 11 further comprises a first positioning element 18 and the second edge 21 comprises a second positioning element 28. The first and second positioning elements 18, 28 are configured to engage with each other and decrease the vertical movement of the second panel 2 relative to the first panel 1 toward the second panel surface 13 in the locked position.

This can be beneficial when panels slightly differ in height or when a flexibility of some portions of the locking element needs to be compensated for by positioning the second panel 2 relative the first panel 1 correctly. Such positioning can provide additional benefits, such as decreasing noise when the panel is in use. Such a noise may occur when assembled panels 1 and 2 move during use causing a temporarily displacement of portions of the locking element in relation to each other when the pressure is applied. Sometimes such displacement can lead to a noise, for example squeaking nose, which is not pleasant for a consumer. Above shortcomings can be at least partially overcome by providing positioning elements in accordance with any or all embodiments of the disclosure.

The locking strip may be integrally formed by the first panel, preferably by the core of the first panel. The tongue and the tongue groove are preferably integrally formed by the first and the second panel respectively, most preferably formed by the core.

The core of the first panel 1 and/or of the second panel 2 may be a wood-based core, preferably made of MDF, HDF, OSB, WPC, plywood or particleboard. The core may also be a plastic core comprising thermosetting plastic or thermoplastic e.g., vinyl, PVC, PU or PET. The plastic core may comprise fillers and or colour particles, and/or wear resistant particles. The filler may be one or more wood fibre and or glass fibre. The core may also be mineral based board which may comprise e.g., MgO.

The first panel 1 and/or the second panel 2 may also be of solid wood.

The first panel 1 and/or the second panel 2 may be provided with a decorative layer, such as a foil or a veneer, on one or more surfaces.

Figure 2A:
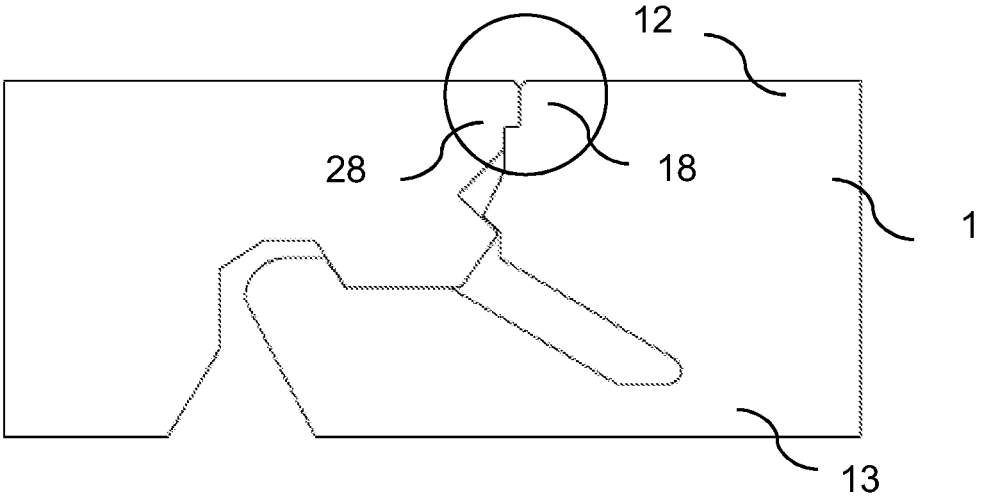
Figure 2B:
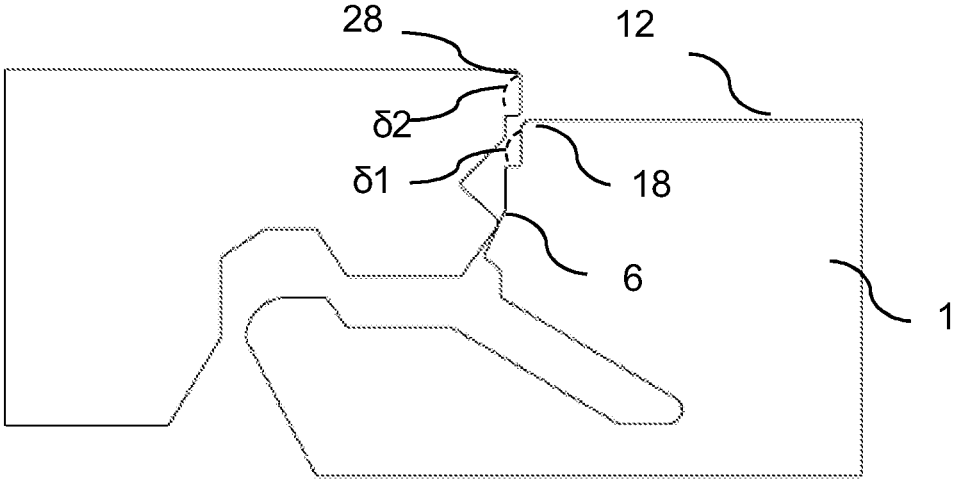

A second aspect of the disclosure is shown, e.g., in FIGS. 2A-2B, which show a set of panels comprising first and second positioning elements 18, 28. The first and the second positioning elements 18, 28 have corresponding engaging surfaces. A first angle 61 between the engaging surfaces of the first positioning element, and a second angle 62 between the engaging surfaces of the second positioning element, are both about 90°.

It shall be understood that the term "about" includes a margin for a measurement error which may be between 1° and 3°.

Figure 2C:
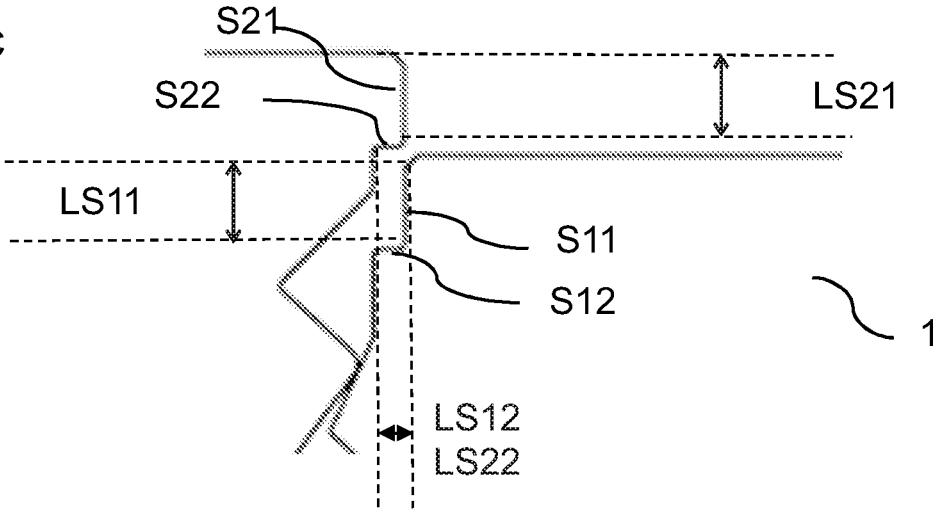

As shown in FIG. 2C, the first positioning element 18 has corresponding engaging surfaces S11 and S12, forming a first angle 61. The engaging surface S11 has a length LS11, which may be in the range of about 0.5 mm to about 3 mm. The engaging surface S12 has a length LS12 which may be in the range of about 0.3 to about 2.5 mm.

The second positioning element 28 has corresponding engaging surfaces S21 and S22, forming a second angle 62. Engaging surface S21 has a length LS21, and engaging surface S22 has a length LS22.

The length LS11 of the engaging surface S11 may be the same as the length LS21 of the engaging surface S21. This can help maintain a co-planar relationship between the top surfaces of the panels.

The length LS12 of the engaging surface S12 may be the same as the length LS22 of the engaging surface S22. This can help minimize a visible gap between the top surfaces of the panels.

A 90° angle between engaging surfaces as exemplified in FIG. 2B can contribute to holding the locking element in a predefined position, in particular positioning the second panel 2 at a predefined portion of the first panel 1 and providing a fixed point for the flexible elements in a locked position.

An aspect of placing of the first and the second positioning elements 18, 28 is, e.g., shown in FIG. 2A. The first positioning element 18 is located on a portion of the first edge 11, preferably located between the first panel surface 12 and the tongue 5 or the tongue groove 6. In addition to the advantage discussed above, a further advantage of this embodiment can be that the panels 1, 2 can be positioned in relation to each other close to the first panel surface 12 which would be typically visible to the consumer. A tight contact at a visible surface area of the set can be formed, thereby providing a smooth surface at a junction between the first panel and the second panel.

In another aspect of the disclosure, the second positioning element 28 is located on a corresponding portion of the second edge 21.

Figure 3A:
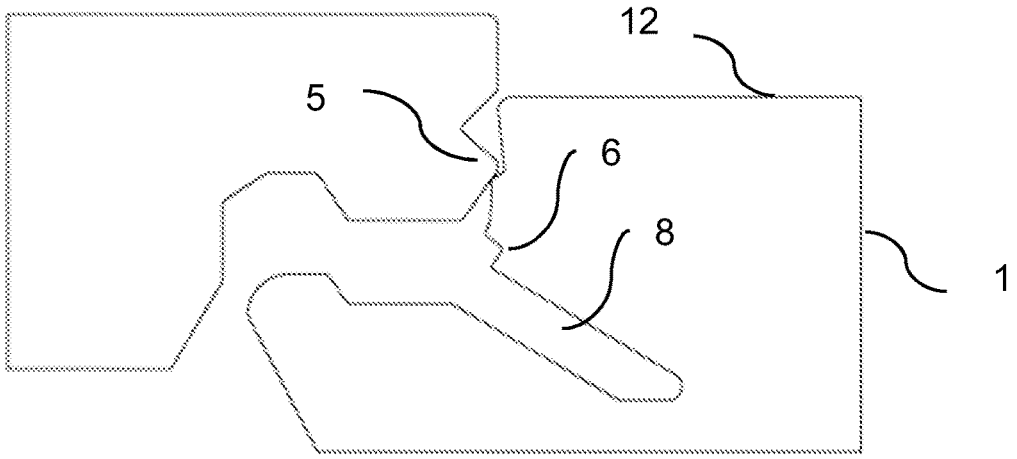
FIGS. 3A-3C each show a side view of a set of illustrative panels wherein a first positioning element is positioned on a tongue groove 6 and a second positioning element is positioned on a tongue 5.
Figure 3B:
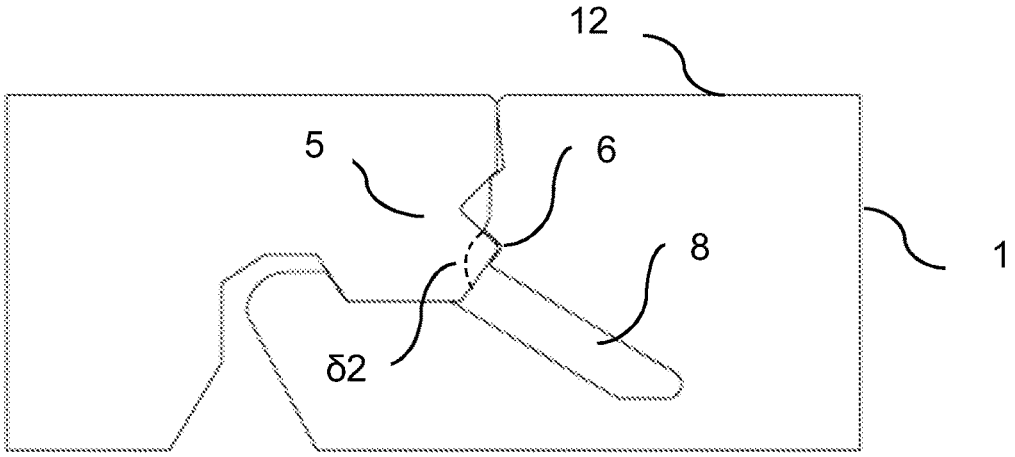
Figure 3C:
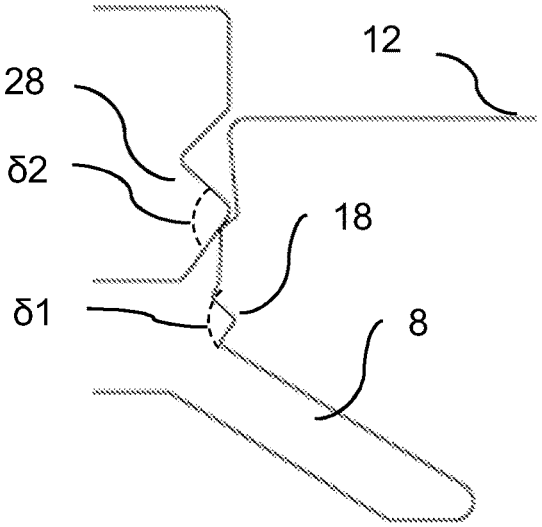

Another aspect of the location of the first and second positioning elements 18, 19 is shown in FIGS. 3A-3C. The first positioning element 18 may be located on the tongue groove 6 and the second positioning element 28 may be located on the tongue 5.

In a preferred embodiment, the first positioning element 18 may be formed by the tongue groove 6 and the second positioning element 28 may be formed by the tongue 5.

When the positioning elements 18, 28 are respectively positioned on a tongue groove 6 and a tongue 5, a potential advantage is that the flexible parts of the panels 1, 2 can be more precisely positioned in relation to each other during assembling. This can allow for an easy and precise assembling of the panels. Additional benefits can be apparent when the panels are in a locked position. For example, noise occurring when the vertical pressure is applied on the assembled panels during use can be decreased. Such a noise may occur when assembled panels 1 and 2 move during use, causing a temporarily displacement of flexible portions of the locking element in relation to each other when the pressure is applied. Sometimes such displacement can lead to a noise, for example squeaking nose, which is not pleasant for a consumer.

Figure 4A:
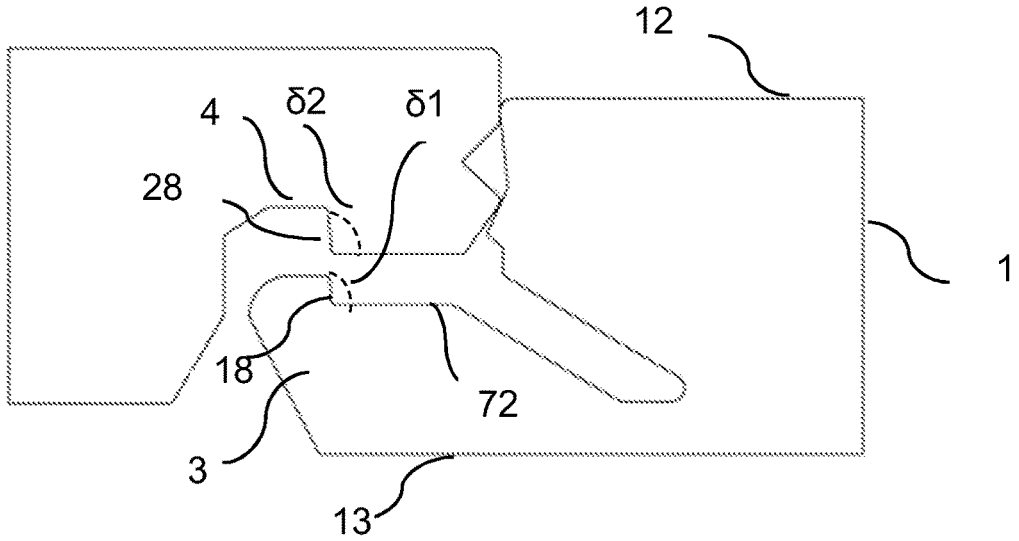
FIGS. 4A-4C each show a side view of a set of illustrative panels wherein a first positioning element 18 is located on the first locking strip surface 72.
Figure 4B:
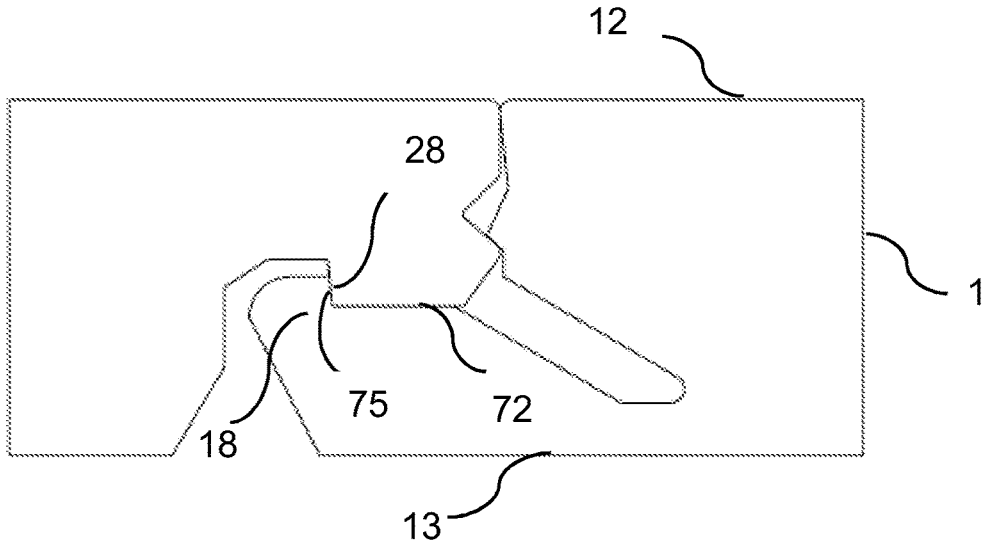

Another aspect of the location of the first and second positioning elements 18, 28 is shown in FIGS. 4A-4B, wherein the first positioning element 18 is located on the first locking strip surface 72. At least one engaging surface of the first positioning element 18 and a corresponding engaging surface of the second positioning element 28 are located in a plane corresponding to a plane of the first panel surface 12 and the second panel surface 13.

In another aspect of the disclosure the first positioning element 18 is formed by the first locking strip surface 72 and the adjusting wall 75 of the locking element 3.

One engaging surface of the second positioning element 18 may be located in a plane substantially perpendicular to the first panel surface 12 and/or the second panel surface 13, and may be formed by a wall of the locking groove 4.

Figure 4C:
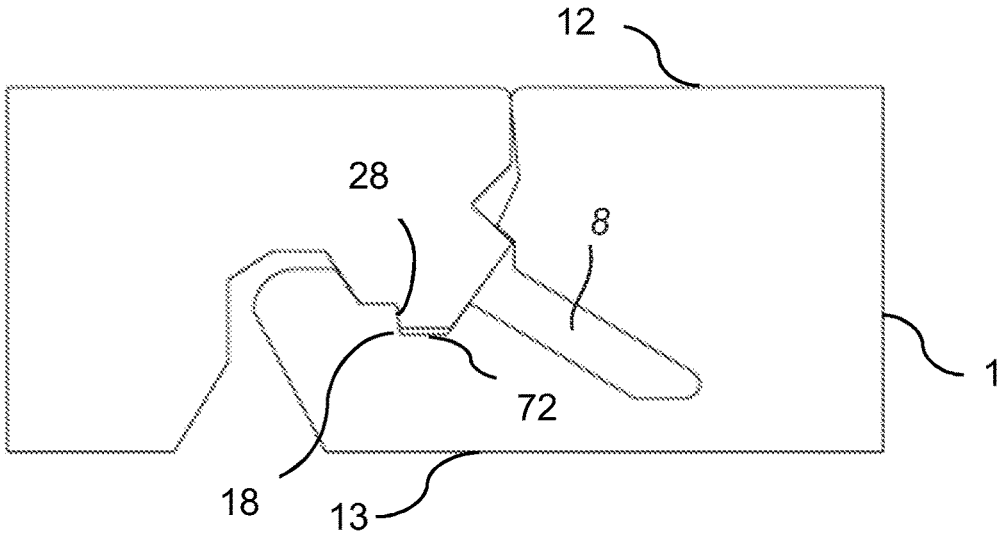

FIG. 4C shows another embodiment wherein the first positioning element 18 is located on a first locking strip surface 72 between a first flexing groove 8 and the locking strip 7.

Figure 5A:
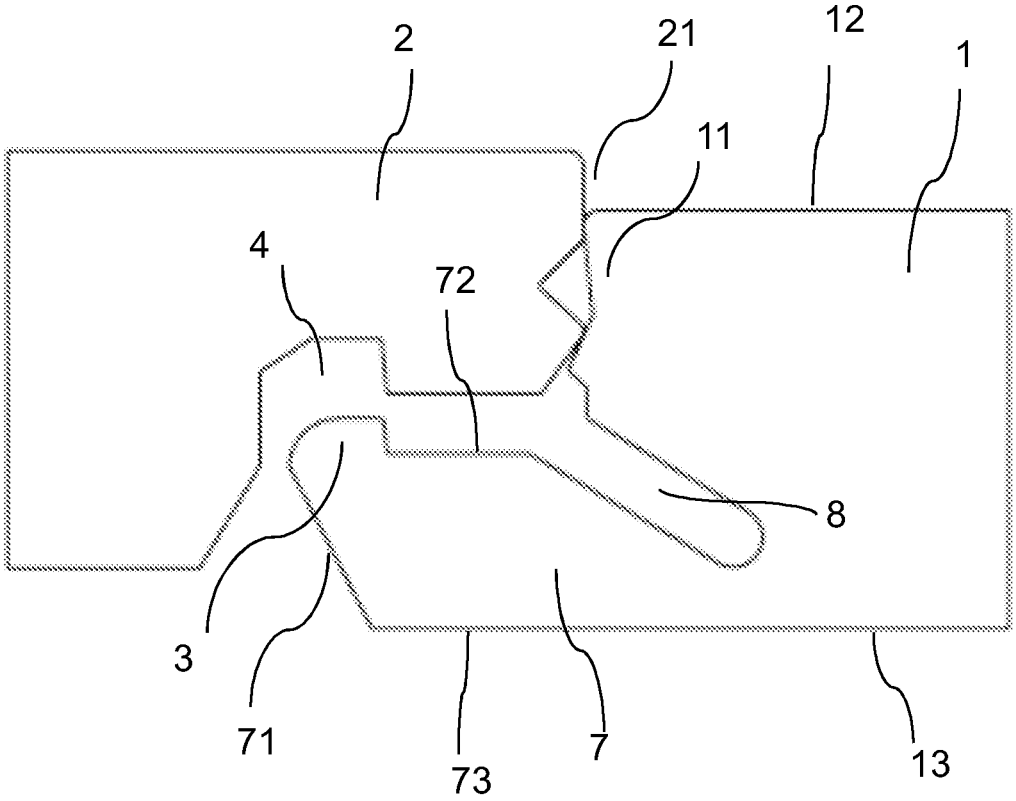
FIGS. 5A-5B each show a side view of a set of illustrative panels comprising a first flexing groove 8 extending at a third angle $\alpha$ from the first panel surface.
Figure 5B:
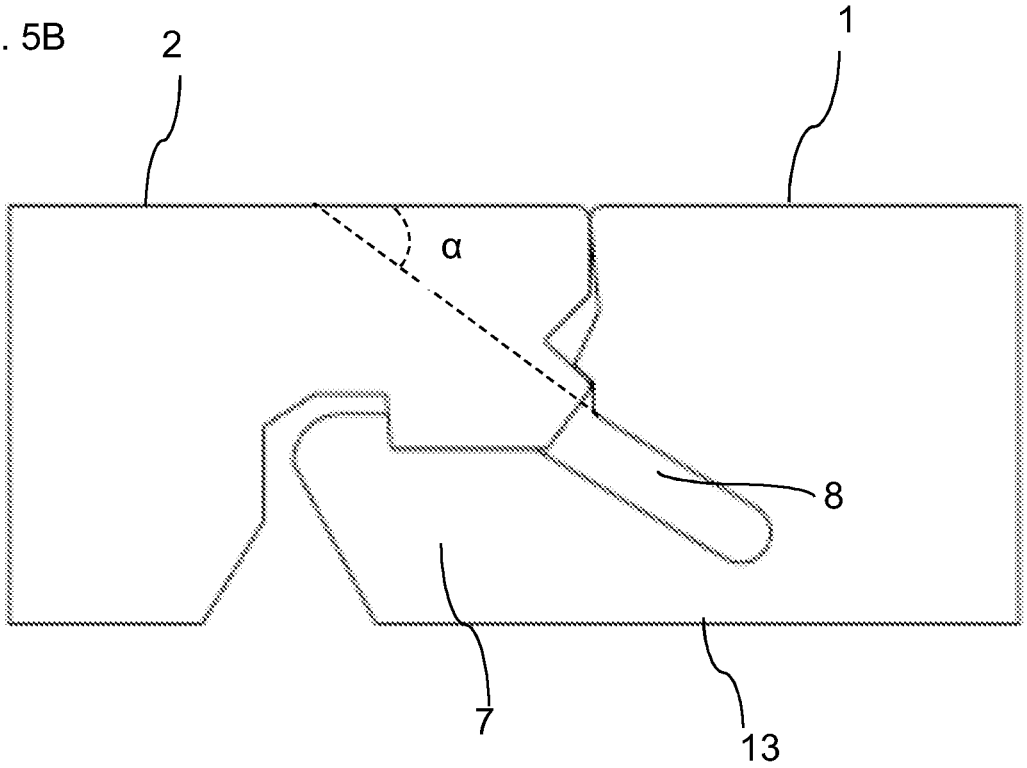

As shown for example in FIGS. 5A-5B, in another aspect the mechanical locking device comprises a first flexing groove 8 extending from a transition between the first locking strip surface 72 and the first edge 11 and into the first panel 1 at a third angle $\alpha$ from the first panel surface 12. The locking strip 7 is configured to flex by varying a shape of the first flexing groove 8 during the assembly, thereby increasing a flexibility of the locking strip 7 during the assembly in the direction of the second panel surface 12. This can make panels easy to assemble.

Due to the presence of the positioning elements 18, 28 the second panel may be positioned at a predetermined position relative to the first panel during assembling of the panel set, even if flexibility of the panels is increased. Further, a temporally displacement of the panels or portions of the locking elements of the assembled panel set can be minimized, in particular, when a pressure is applied in a vertical direction 10, when the panels are in the locked position.

In another aspect the third angle $\alpha$ may be within the range of about 0° to about 30°, preferably within the range of about 0° to about 20°, more preferably within the range of about 0° to about 10°, even more preferably within the range of about 0° to about 5°. A smaller third angle $\alpha$ may be preferred for panels with a smaller thickness Q to allow for a first flexing groove 8 with a greater depth D.

Figure 6:
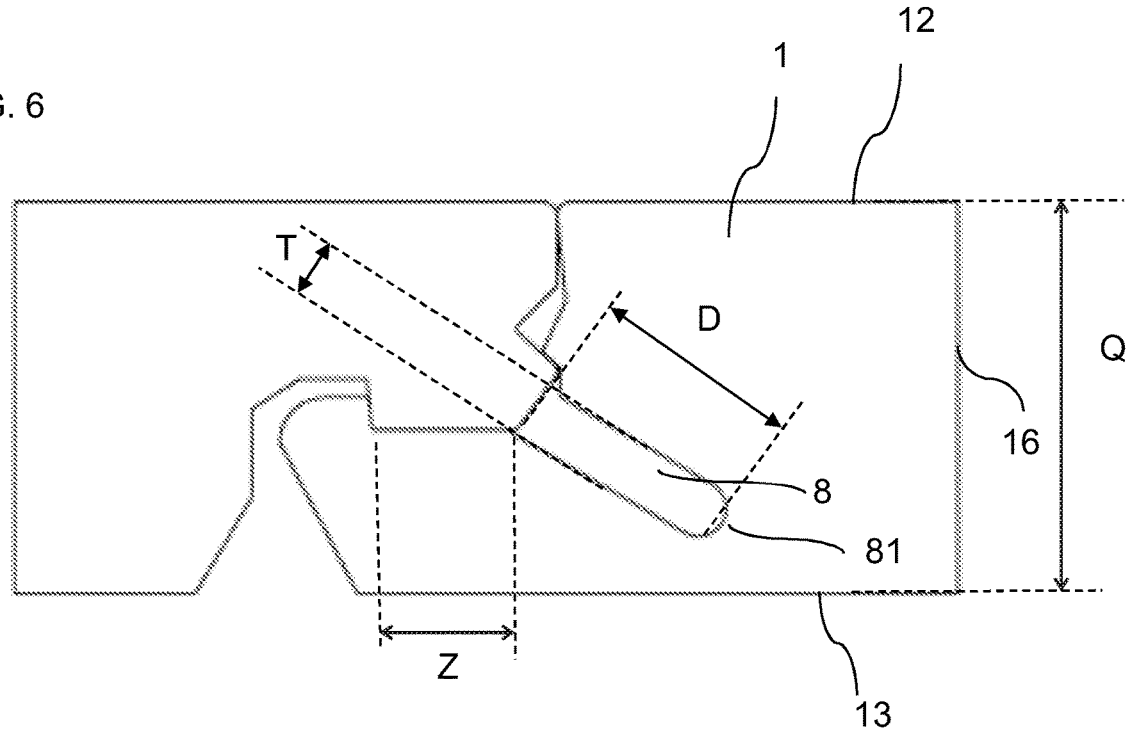
FIG. 6 shows a side view of a set of illustrative panels in an assembled state wherein the dimensions of the first flexing groove 8 are disclosed.

As shown for example in FIG. 6, in another aspect an opening of the first flexing groove 8 has a width T.

The width T of the opening of the first flexing groove 8 may be within the range of about 0.6 mm to about 2.5 mm, preferably about 0.8 mm to about 2.0 mm, more preferably about 1.6 mm. The values are high enough to allow an easy assembling and low enough to allow a sufficient locking strength. A width T of 2 mm may provide an easier assembling and width T of 0.6 mm may provide a higher locking strength. The preferred value can depend on, e.g., the material of the locking strip. A greater width may have the advantage that the risk for cracks are reduced, particularly for brittle materials, such as HDF and plastic material with a high amount of fillers.

In another embodiment the ratio between the width T of the opening of the first flexing groove 8 and a thickness Q of the first panel 1 between the first panel surface 12 and the second panel surface 13 is within the range of about 0.05 to about 0.40, preferably about 0.1 to about 0.3, more preferably about 0.15-0.20. The ratios are high enough to allow an easy assembling and low enough to allow a sufficient locking strength. A ratio of 0.4 may provide an easier assembling and a ratio of 0.05 may provide a higher locking strength. The preferred value can depend on, e.g., the material of the locking strip. A greater ratio may have the advantage that the risk for cracks are reduced, particularly for brittle materials, such as HDF and plastic material with a high amount of fillers.

In another embodiment the first flexing groove 8 has a depth D. The depth D that is within the range of about 2.5 mm to about 15 mm, preferably about 4 mm to about 12 mm, more preferably about 5 mm to about 10 mm, even more preferably about 7 mm. The values are high enough to allow an easy assembling and low enough to allow a sufficient locking strength. A depth D of 15 mm may provide an easier assembling and depth D of 2.5 mm may provide a higher locking strength. The preferred value can depend on e.g. the material of the locking strip.

In another embodiment the ratio between the depth D of the first flexing groove 8 and the width T of the groove 8 is about 2 to about 10, preferably about 3 to about 7, more preferably about 4. The ratios are high enough to allow an easy assembling and low enough to allow a sufficient locking strength. A ratio of 10 may provide an easier assembling and a ratio of 2 may provide a higher locking strength. The preferred value can depend on, e.g., the material of the locking strip.

In another embodiment the first flexing groove 8 has a bottom 81, and the bottom is preferably convex shaped. A convex shape may have the advantage that the risk for cracks are reduced, particularly for brittle materials, such as HDF and plastic material with a high amount of fillers.

In one aspect of the disclosure one aspect the bottom 81 of the first flexing groove 8 may be essentially arch shaped. An arch shaped bottom 81 may have the advantage that the risk for cracks are reduced, particularly for brittle materials, such as HDF and plastic material with a high amount of fillers.

In one aspect the bottom 81 of the first flexing groove 8 may be essentially triangular.

In one aspect a cross-sectional shape of the first flexing groove 8 may be essentially rectangular or square.

In another embodiment the first locking strip surface 72 has a length Z that may be within the range of about 2 mm to about 10 mm, preferably about 3 mm to about 5 mm, more preferably about 4 mm.

In another embodiment the ratio between the length Z of the first locking strip surface 72 and the width T of the opening of the groove 8 may be within the range of about 1 to about 6, preferably about 2 to about 5, or preferably about 2.5.

In one embodiment a locking element 3 is chamfered beveled or arch-shaped. An embodiment wherein a locking element 3 is arch-shaped is shown on FIG. 7. A skilled person would understand how to form the locking element to be chamfered or beveled.

Figure 7:
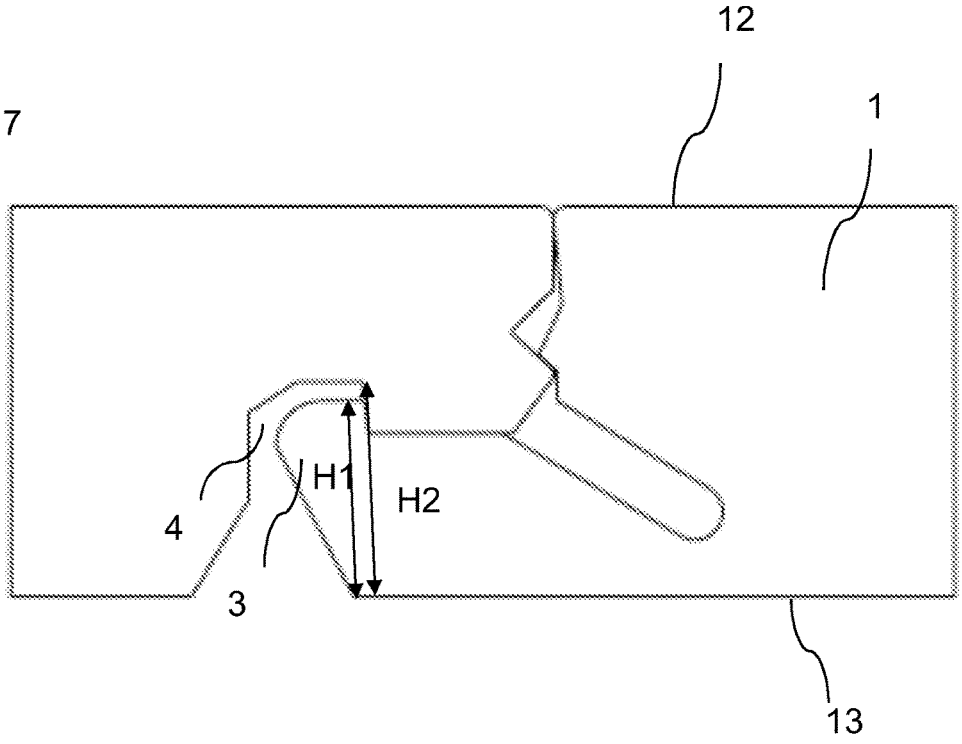
FIG. 7 shows a side view of set of illustrative panels in an assembled state wherein the locking element is arch shaped and H1 is a height of the locking element 3 and H2 is a height of the groove 4.

As shown for example in FIG. 7, the locking element has a height H1 measured from the second panel surface 12 to the highest point of the locking element in a direction substantially perpendicular to the first panel surface 12 and/or the second panel surface 13. The groove 4 has a height H2, measured from the second panel surface 12 to the highest point of the groove 4 in a direction substantially perpendicular to the first panel surface 12 and/or second panel surface 13.

In one embodiment the difference between the height H2 of the groove 4 and the height H1 of the locking element 3 may be in the range of about 0 to about 2 mm, or in the range of about 0.2 mm to about 1 mm, or about 0.5 mm.

In one embodiment the locking strip 7 comprises a second flexing groove 9, as shown for example in FIGS. 8A, B and D, extending from the locking strip edge 71 into the locking strip 7. The second flexing groove 9 is configured to further increase a flexibility of the locking strip 7 during the assembly. The illustrative embodiment shown in FIG. 8C is free of a second flexing groove 9.

The second flexing groove 9 may be positioned on a lower portion of the locking strip edge 71 adjacent to the bottom surface of the locking strip 73.

The second flexing groove 9 may be positioned such that it extends into the body of the locking strip 7, as shown for example in FIG. 8B.

In an embodiment the second flexing groove 9 may extend into the locking strip 7 in a plane substantially corresponding to the first and the second panel surface 12, 13, as also shown for example in FIG. 8B.

In another embodiment the second flexing groove may be arch-shaped, as shown for example in FIG. 8D.

In another embodiment the locking strip edge 71 is beveled or curved.

A first groove element surface 41 may be beveled.

The first groove element surface 41 shape may be combined with any embodiment of the first flexing groove 8 and/or second flexing groove 9.

All the embodiments of the first groove element surface 41 and the first and second flexing grooves 8, 9 may be combined with any embodiments of the first and the second positioning elements.

In some embodiments the panels are floor panels or wall panels.

In an embodiment the first panel 1 and the second panel 2 are preferably floorboards configured to be locked together to obtain a floor product.

In an embodiment the first panel 1 and the second panel 2 are wall panels to be locked together to obtain a wall product.

The first panel 1 and the second panel 2 may be of a rectangular shape.

The first panel 1 may comprise an edge opposite the first edge which is essentially identical to the second edge of the second panel 2.

The second panel 2 may comprise an edge opposite the second edge which is essentially identical to the first edge of the first panel 1.

The first edge and the second edge may be short edges of the first panel and the second panel.

The assembling may also comprise an angling motion along a long side of the first and or the second panel.

Further embodiments of the disclosure are described below:

1. A set of panels comprising a first panel (1), a second panel (2) and a mechanical locking device for locking the first panel (1) to the second panel (2), the mechanical locking device being configured for an assembly by a displacement of the second panel (2) in relation to the first panel (1) in a vertical direction to obtain a locked position of the first panel (1) and the second panel (2), wherein the first panel (1) comprises a first edge (11), a first panel surface (12) and a second panel surface (13) and the second panel (2) comprises a second edge (21), wherein the mechanical locking device comprises a locking strip (7) extending from the first edge (11) in a direction parallel to the first and second panel surfaces (12, 13), wherein the locking strip (7) comprises a locking strip edge (71), wherein the locking strip (7) comprises a first locking strip surface (72) extending in a direction substantially corresponding to the direction of the first panel surface (12) of the first panel (1), wherein the locking strip (7) comprises a second locking strip surface (73) extending in a direction substantially corresponding to direction of the second panel surface (13) of the first panel (1), wherein the locking strip (7) comprises a locking element (3) configured to cooperate with a locking groove (4) at the second edge (21) of the second panel (2) for locking in a direction parallel to the first panel surface (12), wherein one of the first or second edge (11, 21) comprises a tongue (5) configured to cooperate with a tongue groove (6) at the other one of the first or second edge (11, 21) for locking in a vertical direction, wherein the first edge (11) comprises a first positioning element (18) and a second edge (21) comprises a second positioning element (28), the first and second positioning elements (18, 28) being configured to engage with each other and decrease the vertical movement of the second panel (2) relative to the first panel (1) toward the second panel surface (13) in the locked position.

2. The set of panels as described in embodiment 1, wherein the first and second positioning elements (18, 28) have corresponding engaging surfaces, and wherein a first angle (61) between the engaging surfaces of the first positioning element, and a second angle (62) between the engaging surfaces of the second positioning element, are both about 90°.

3. The set of panels as described in embodiments 1 or 2, wherein the first positioning element (18) is located on a portion of the first edge (11), preferably located between the first panel surface (12) and the tongue (5) or tongue groove (6).

4. The set of panels as described in embodiment 3, wherein the second positioning element (28) is located on a corresponding portion of the second edge (21).

5. The set of panels as described in embodiments 1 or 2, wherein the first positioning element (18) is located on the tongue groove (6) and the second positioning element is located on the tongue (5).

6. The set of panels as described in embodiment 5, wherein the first positioning element is formed by the tongue groove (6) and the second positioning element is formed by the tongue (5).

7. The set of panels as described in embodiments 1 or 2, wherein the first positioning element (18) is located on the first locking strip surface (72).

8. The set of panels as described in embodiment 7, wherein the first positioning element is formed by the first locking strip surface (72) and an adjusting wall (75) of the locking element (3).

9. The set of panels as described in any one of the embodiments 1-8, wherein the mechanical locking device comprises a first flexing groove (8) extending from a transition between the first locking strip surface (72) and the first edge (11) and into the first panel (1) at a third angle (a) from the first panel surface (12), and that the locking strip (7) is configured to flex by varying a shape of the first flexing groove (8) during the assembly, thereby increasing a flexibility of the locking strip (7) during the assembly in the direction of the second panel surface (13).

10. The set of panels as described in embodiment 9, wherein the third angle (a) is within the range of about 0° to about 30°, preferably within the range of about 0° to about 20°, more preferably within the range of about 0° to about 10°, even more preferably within the range of about 0° to about 5°.

11. The set of panels as described in embodiment 9 or embodiment 10, wherein an opening of the first flexing groove (8) has a width (T).

12. The set of panels as described in embodiment 11, wherein the width (T) of the opening of the first flexing groove (8) is within the range of about 0.6 mm to about 2.5 mm, preferably about 0.8 mm to about 2.0 mm, more preferably about 1.6 mm.

13. The set of panels as described in any one of the embodiment embodiments 9-12, wherein the ratio between the width (T) of the opening of the first flexing groove (8) and a thickness (Q) of the first panel (1) between the first panel surface (12) and the second panel surface (13) is within the range of about 0.05 to about 0.40, preferably about 0.1 to about 0.3, more preferably about 0.15-0.20.

14. The set of panels as described in any one of the embodiment embodiments 9-13, wherein the first flexing groove (8) has a depth (D) that is within the range of about 2.5 mm to about 15 mm, preferably about 4 mm to about 12 mm, more preferably about 5 mm to about 10 mm, even more preferably about 7 mm.

15. The set of panels as described in embodiment 14, wherein the ratio between the depth (D) of the first flexing groove (8) and the width (T) of the first flexing groove (8) is about 2 to about 10, preferably about 3 to about 7, more preferably about 4.

16. The set of panels as described in any one of the embodiment embodiments 9-15, wherein the first flexing groove (8) has a bottom (81), and the bottom is preferably convex shaped.

17. The set of panels as described in any one of the embodiments 1-16, wherein the first locking strip surface (72) has a length (Z) that is within the range of about 2 mm to about 10 mm, preferably about 3 mm to about 5 mm, more preferably about 4 mm.

18. The set of panels as described in embodiment 17, wherein the ratio between the length (Z) of the first locking strip surface (72) and the width (T) of the opening of the first flexing groove (8) is within the range of about 1 to about 6, preferably about 2 to about 5, or preferably about 2.5 mm.

19. The set of panels as described in any one of the embodiments 1-17, wherein the locking element (3) is chamfered, beveled or arch-shaped.

20. The set of panels as described in any one of the embodiments 1-18, wherein the locking strip (7) comprises a second flexing groove (9) extending from the locking strip edge (71) into the locking strip (7), and the locking strip (7) is configured to flex by varying a shape of the second flexing groove (9) during the assembly, thereby increasing a flexibility of the locking strip (7) during the assembly.

21. The set of panels as described in any one of the embodiments 1-20, wherein the locking strip edge (71) is beveled or curved.

22. The set of panels as described in any one of the embodiments 1-21, wherein the panels are floor panels or wall panels.

The invention claimed is:

1. A set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending in a direction substantially corresponding to a direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, wherein the mechanical locking device comprises a first flexing groove extending from a transition between the first locking strip surface and the first edge and into the first panel at a third angle from the first panel surface, and the locking strip is configured to flex by varying a shape of the first flexing groove during the assembly, and wherein the first edge comprises a first positioning element and a second edge comprises a second positioning element, the first and second positioning elements being configured to engage with each other and decrease vertical movement of the second panel relative to the first panel toward the second panel surface in the locked position, wherein the first and second positioning elements each have a set of corresponding engaging surfaces, and wherein a first angle between the engaging surfaces of the first positioning element, and a second angle between the engaging surfaces of the second positioning element, are both about 90°, wherein the first positioning element is located on a portion of the first edge, wherein the first positioning element is located between the first panel surface and either the tongue or the tongue groove, wherein the second positioning element is located on a corresponding portion of the second edge.

2. The set of panels as claimed in claim 1, wherein the first positioning element is located on the tongue groove and the second positioning element is located on the tongue.

3. The set of panels as claimed in claim 2, wherein the first positioning element is formed by the tongue groove and the second positioning element is formed by the tongue.

4. The set of panels as claimed in claim 1, wherein the first positioning element is located on the first locking strip surface.

5. The set of panels as claimed in claim 4, wherein the first positioning element is formed by the first locking strip surface and an adjusting wall of the locking element.

6. The set of panels as claimed in claim 1, wherein the third angle is within the range of about 0° to about 30°.

7. The set of panels as claimed in claim 1, wherein the width of the opening of the first flexing groove is within the range of about 0.6 mm to about 2.5 mm.

8. The set of panels as claimed in claim 1, wherein the first flexing groove has a depth that is within the range of about 2.5 mm to about 15 mm.

9. The set of panels as claimed in claim 8, wherein the ratio between the depth of the first flexing groove and the width of the first flexing groove is about 2 to about 10.

10. The set of panels as claimed in claim 1, wherein the first flexing groove has a bottom.

11. The set of panels as claimed in claim 1, wherein the first locking strip surface has a length that is within the range of about 2 mm to about 10 mm.

12. The set of panels as claimed in claim 11, wherein the ratio between the length of the first locking strip surface and the width of the opening of the first flexing groove is within the range of about 1 to about 6.

13. The set of panels as claimed in claim 1, wherein the locking element is chamfered, bevelled or arch-shaped.

14. The set of panels as claimed in claim 1, wherein the locking strip comprises a second flexing groove extending from the locking strip edge into the locking strip, and the locking strip is configured to flex by varying a shape of the second flexing groove during the assembly, wherein the first panel surface is at a top of the first panel, and an opening of the second flexing groove is vertically lower than an opening of the first flexing groove.

15. The set of panels as claimed in claim 1, wherein the locking strip edge is bevelled or curved.

16. The set of panels as claimed in claim 1, wherein the panels are floor panels or wall panels.

17. The set of panels as claimed in claim 1, wherein the ratio between a width of an opening of the first flexing groove and a thickness of the first panel between the first panel surface and the second panel surface is within the range of about 0.05 to about 0.40.

18. A set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending in a direction substantially corresponding to a direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, wherein respective horizontal surfaces of the tongue and the tongue groove contact each other in the tongue groove in the locked position for locking in the vertical direction, wherein the mechanical locking device comprises a first flexing groove extending from a transition between the first locking strip surface and the first edge and into the first panel at a third angle from the first panel surface, and the locking strip is configured to flex by varying a shape of the first flexing groove during the assembly, and wherein the first edge comprises a first positioning element and a second edge comprises a second positioning element, the first and second positioning elements being configured to engage with each other and decrease vertical movement of the second panel relative to the first panel toward the second panel surface in the locked position, wherein a core of the first panel and/or of the second panel is selected from the group of: a solid wood core, a wood-based core, a plywood core, a particleboard core, a plastic core, and a mineral based board core.

19. The set of panels as claimed in claim 18, wherein the ratio between a width of an opening of the first flexing groove and a thickness of the first panel between the first panel surface and the second panel surface is within the range of about 0.05 to about 0.40.

20. The set of panels as claimed in claim 18, wherein the first panel surface is at a top of the first panel, and wherein the respective horizontal surfaces of the tongue and the tongue groove are vertically lower than a topmost surface of the locking element in the locked position.

* * * * *